United States Patent [19]

MacLeod

[11] Patent Number: 4,836,760

[45] Date of Patent: Jun. 6, 1989

[54] INLET FOR A POSITIVE DISPLACEMENT PUMP

[75] Inventor: Edward N. MacLeod, Waltham, Mass.

[73] Assignee: Parker Hannifin Corporation, Cleveland, Ohio

[21] Appl. No.: 25,232

[22] Filed: Mar. 12, 1987

[51] Int. Cl.[4] ..... F04C 2/10

[52] U.S. Cl. ..... 418/166; 418/259

[58] Field of Search ..... 418/150, 166, 171, 259

[56] References Cited

U.S. PATENT DOCUMENTS 2,458,678 1/1949 Bunte ..... 418/171

3,715,177 2/1973 Woodier ..... 418/171

*Primary Examiner*—John J. Vrablik

*Assistant Examiner*—Leonard P. Walnoha

*Attorney, Agent, or Firm*—Christopher H. Morgan

[57] ABSTRACT

An improved positive displacement rotary pump, such as a gerotor pump, having an axial housing inlet opening with an outer radial edge extending inside the radial outer extent of the rotating fluid in the pump such that at design speed, the fluid pressure due to rotation of the fluid, does not cause fluid to move back into the inlet. Otherwise, the inlet is maximally open to allow maximum filling efficiency.

1 Claim, 2 Drawing Sheets

INLET FOR A POSITIVE DISPLACEMENT PUMP

BACKGROUND OF THE INVENTION

1. Field of the Invention

This invention relates to positive displacement pumps and more particularly to positive displacement pumps having rotary displacement mechanisms and axial inlets.

2. Brief Description of the Prior Art

Positive displacement pumps with rotary displacement mechanisms are well known in the art. Internal gear pumps, spur gear pumps, vane pumps and rotary piston pumps with nutating pistons are well known rotary positive displacement pumps. In all of these devices, the rotary mechanism is surrounded by a housing which, together with the rotary mechanism, creates chambers which increase and decrease in volume because of the rotation. The chambers increasing in volume serve as the inlet and the chambers decreasing in volume serve as the outlet. In an internal gear pump with a stationary housing, for example, an inlet is disposed in one half of the housing and an outlet is disposed in the other half. Fluid moves into the inlet chambers of the pump through the housing inlet opening because the chambers are increasing in volume. Fluid exits the outlet chambers through the housing outlet because the chambers are decreasing in volume.

Based on the conventional wisdom of the prior art, the opening for the inlet and outlet are open as wide as possible to reduce pressure drop across these openings as the fluid moves into and out of the inlet chambers. Of course, the inlet and outlet must be separated so that significant flow does not occur from the outlet to the inlet across the sealing surfaces on the rotating mechanism.

A problem in the operation of positive displacement pumps has been encountered when the rotational speeds are required to be high or the inlet pressures are required to be low. Such conditions often occur in aerospace applications where the pump must operate at high altitude and therefore low inlet pressures. Further, such applications generally require low weight which means that the pump must be of small size requiring higher rotation speeds in order to achieve sufficient volume flow.

Among the problems encountered as a result of high speed and low inlet pressure design conditions, are cavitation and inlet filling inefficiency. These problems are related in that low efficiency in filling the inlet can cause cavitation. One attempted solution to this problem is to move the trailing edge of the inlet and the leading edge of the outlet in the direction of rotation so that the inlet is enlarged and the outlet is reduced. This gives the fluid more time and space to enter the inlet. However, volumetric capability is reduced with this technique, and despite some improvement resulting from this so called advance of the inlet, cavitation and low inlet filling efficiency remain a problem.

SUMMARY OF THE INVENTION

It is accordingly an object of the present invention to provide an improved positive displacement pump which will operate more efficiently at higher rotational speeds and lower inlet pressures.

It is also an object of the present invention to provide an improved positive displacement pump having a conventional rotary displacement mechanism and an improved housing inlet.

Still another object of the present invention is to provide an improved positive displacement pump which is easier to manufacture and design while being more efficient in its operation.

In accordance with these objects, the present invention provides an improved positive displacement pump having a rotary displacement mechanism. A housing surrounds the rotary displacement mechanism and forms therewith a displacement inlet cavity which, during rotation, has an extreme outer boundary and an extreme inner boundary with respect to the axes of rotation. An axial housing inlet is provided in the housing to communicate fluid to the inlet cavity. The axial housing inlet has a radially outer covering edge, a radially inner edge, a leading edge and a trailing edge. The radially outer covering edge extends radially inside the outer boundary of the inlet cavity to cover an outer section of the inlet cavity so that fluid which enters the inlet cavity through the inlet will not exit the inlet cavity as a result of fluid pressure created in the inlet cavity by rotation of the fluid.

Rotation of the fluid in the inlet cavity creates a pressure gradient from the bottom (radially inner portion) to the top (radially outer portion) of the cavity. This pressure gradient can cause a recirculation of the fluid in a conventional inlet cavity with high pressure fluid exiting the rotating inlet at the radially outermost area of the inlet port and then reentering at the innermost area of the inlet. This recirculation is made worse by the conventional technique of radially enlarging the inlet cavity. By the present invention it has been discovered that making the inlet opening radially smaller instead of larger can improve the efficiency of the pump, especially at high speeds and/or low inlet pressures.

The inlet opening is made smaller by reducing the outer boundary of the housing inlet. This creates a radially outer covering edge of the housing inlet and prevents this recirculation. Preferably, the rotational speed of the fluid, the density of the fluid, the fill velocity, the inlet pressure and the radius of the inner boundary of the inlet cavity are utilized to design the covering edge of the housing inlet to allow a maximally open inlet while still preventing fluid flow out of the cavity back into the housing inlet. These elements can be used to predict the point at which the rotationally created pressure in the rotating fluid equals the inlet pressure, and the inlet opening radially outside of that point is covered.

For further understanding of the invention and further objects, features and advantages thereof, reference may now be had to the following description taken in conjunction with the accompanying drawings.

DESCRIPTION OF PREFERRED EMBODIMENTS

Figure 1:
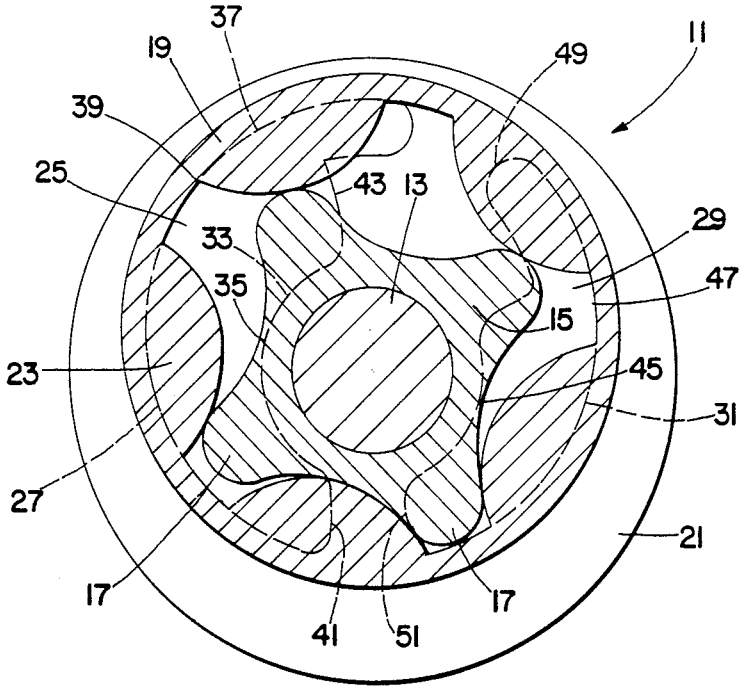
Fig. 1 PRIOR ART
FIG. 1 is a cross-sectional view of a portion of a pump constructed in accordance with the prior art.

Referring now to FIG. 1, a positive displacement internal gear pump constructed in accordance with the prior art is shown at 11. The internal gear pump 11 is of a type often referred to as a gerotor pump. The prior art pump includes a drive shaft 13 which is fixedly joined to an inner pumping element or gerotor 15. The inner gerotor 15 has four teeth 17, the radial outer edges of which follow a generally trochoidal shape. An outer pumping element or gerotor 19 is mounted for rotation in a housing 21 and extends about the inner gerotor 15. The outer gerotor 19 has five teeth 23 which are curved to mate with the outer edges of the inner gerotor 15 as it rotates. The inner gerotor 15 has an axis which is offset from the outer gerotor 19 so that gaps are present between the inner and outer gerotor. These gaps open and close in a cycle which repeats with each rotation of the inner gerotor 15. As is well known, the number of teeth in a gerotor pump may vary over a wide range and the use of a pump with the numbers of teeth shown is not critical or limiting.

As shown in FIG. 1, the inner gerotor 15 rotates clockwise as driven by the drive shaft 13. The rotation of the inner gerotor drives the outer gerotor to also rotate clockwise. Thus, as shown in FIG. 1, gaps between the inner and outer gerotor are opening on the left side of the gerotor pump and are closing on the right side of the gerotor pump.

The inner and outer gerotor have axial ends or faces which are planar and transverse to the axis of their rotation. These axial ends fit closely within the housing 21 for a fluid seal during the rotation of the inner and outer gerotor. An axial inlet opening is provided in the sealing surface adjacent the ends of the inner and outer gerotor in the housing 21. The boundary 27 of the inlet opening 25 is shown mostly in dotted lines in FIG. 1. The inlet opening 25 is provided on the left side of the gerotor pump 11 as shown in FIG. 1 so that fluid will be drawn into the gaps between the inner and outer gerotor as the gaps open in their clockwise rotational cycle.

An axial outlet opening 29 is provided in the housing 21 adjacent the axial ends of the inner and outer gerotor on the right side of the housing 21. The boundary 31 of the outlet opening 29 is shown in FIG. 1. The outlet opening 29 extends adjacent to the gaps on the right side of the housing 21 as shown in FIG. 1 to receive the fluid expelled from the gaps as the gaps are closing in their rotational cycle.

The boundaries 27 and 31 which are shown in FIG. 1 are constructed in accordance with the conventional wisdom of the prior art which is that pumping efficiency will be improved by providing maximally open openings while still providing sealing surfaces to prevent fluid losses as, for example, when fluid moves from the outlet to the inlet. Thus, the radially inner edge of the inlet opening 25 extends adjacent the furthest inward extent of the gaps opening between the inner and outer gerotors; i.e. along a radius which would be drawn by a root 35 of the inner gerotor 15 as it rotates. Similarly, the radially outer edge 37 of the inlet opening 25 extends adjacent the outermost extent of the opening gaps between the inner and outer gerotors as they open; i.e. along a radius which would be drawn by a root 39 of the outer gerotor 19.

The leading edge 41 of the inlet opening 25 extends as close as possible to the left right dividing line in FIG. 1 while still maintaining a seal against fluid leakage. The trailing edge 43 of the inlet opening 25 extends beyond the left right dividing line of FIG. 1 because it has been found in the prior art that filling efficiencies can be improved by extending the trailing edge of the inlet beyond the normal sealing point. This is especially true for faster rotational speeds and lower inlet pressures where filling efficiencies are lowest.

The radially inner edge 45 of the outlet opening 29 also extends to the radially innermost extent of the gaps which are closing between the inner and outer gerotors; i.e. the radius which would be drawn by a root 35 of the inner gerotor 15 as it rotates. The radially outer edge 47 of outlet opening 29 extends axially adjacent to the outer extent of the closing gaps between the inner and outer gerotors; i.e. along a radius which would be drawn by a root 47 of the outer gerotor 19. The leading edge 49 of the outlet opening 29 extends as close as possible to sealingly separate the outlet 29 from the trailing edge 43 of the inlet 25. Similarly, the trailing edge 51 of the outlet opening 29 extends as close as possible to the leading edge 41 of opening 25 so as to provide a seal therebetween.

Thus, in accordance with the prior art the openings 25 and 29 are maximally opened with respect to the inner and outer gerotor gaps while still providing a seal therebetween. In fact, because of filling inefficiencies, the inlet opening 25 is extended or advanced beyond the maximal extent at its trailing edge 43. This was thought to provide the optimum filling and emptying efficiencies. These filling and emptying efficiencies were critically important with respect to faster rotating gerotor pumps and pumps which must operate at low inlet pressure conditions; for example, the conditions required for a low weight, high speed, high altitude fluid pump for an aircraft.

Figure 2:
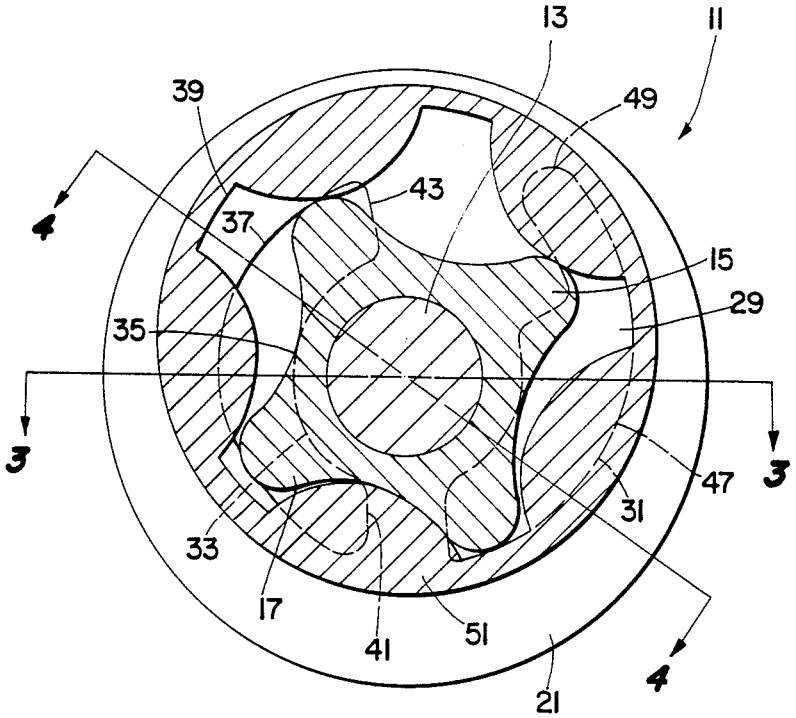
FIG. 2 is a cross-sectional view of a portion of a pump constructed in accordance with the present invention and taken along the same lines as FIG. 1.
Figure 3:
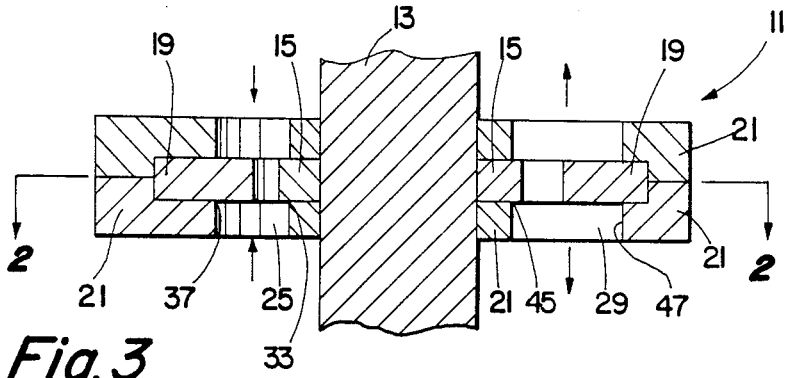
FIG. 3 is a longitudinal cross-sectional view of the pump of FIG. 2 taken along the lines shown in FIG. 2.
Figure 4:
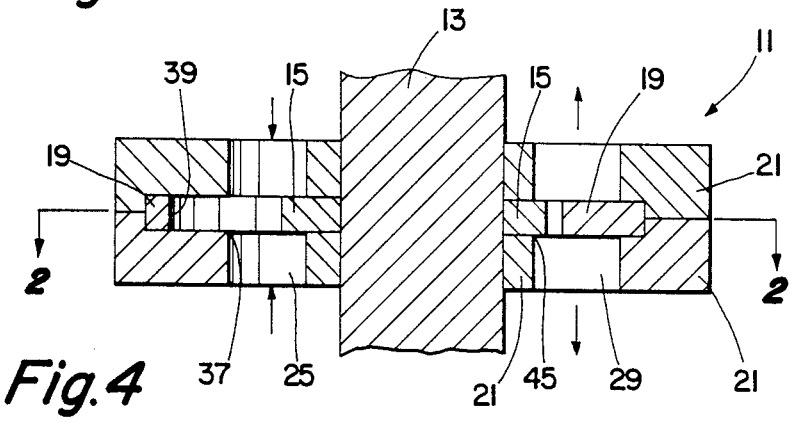
FIG. 4 is a longitudinal cross-sectional view of the pump of FIG. 2 taken along the lines shown in FIG. 2.

Referring now to FIGS. 2 through 4, a gerotor pump constructed in accordance with the present invention is shown and numbered using the same numbering as the gerotor pump shown in FIG. 1. However, contrary to the teachings of the prior art, the present invention has discovered that an inlet opening 25 as wide as the prior art opening in FIG. 1 is not the most efficient filling opening. Instead, an inlet opening 25 which has a radially outer edge 37 substantially inside the outer extent of the opening gaps between the inner and outer gerotor is more efficient in filling.

The inner edge 33 of the inlet opening 25 is disposed along the furthest radially inward extent of the opening gap between the inner and outer gerotors. In other words, the inner edge of the inlet opening is a radius which extends adjacent the travel of the root 35 of the inner gerotor 15, the same radius as in prior art inlet openings. Similarly, the leading edge 41 of the inlet opening 25 is disposed as close as possible to the left-right dividing line as shown in FIG. 2. This is the same position as the leading edge of the inlet opening of the prior art.

The trailing edge 43 of the inlet opening 25 may be advanced in order to increase the opening area and to improve filling efficiency. However, because the reduced radius outer edge 37 improves the filling efficiency of the inlet opening 25, less advance of the trailing edge 43 is possible. Utilizing the design criteria above, it can be seen that the resulting inlet opening is substantially kidney-shaped with a reduced radially outer edge.

The design of the outlet opening 29 is the same as the design of prior art outlet openings except that the leading edge 49 may be moved counterclockwise because advancement of the trailing edge 43 of the inlet opening may be reduced. The inner and outer edges 45 and 47 of the outlet opening 29 remain at the inner and outer extents of the closing gaps between the inner and outer gerotors.

It is believed that the improved efficiency of the inlet opening of the present invention results from the filling flow of the present invention compared to the filling flow in prior art inlet openings. In prior art pumps operating at a sufficiently high speed, fluid which enters the gap between the inner and outer gerotors may be forced out of the gap and back into the inlet opening in the housing because the pressure at the outer extent of the gap becomes higher than the inlet pressure due to the rotation of the fluid in the gap. In other words, rotation of the fluid causes the pressure in the fluid to increase in the radially outer portions of the rotating fluid. If the rotation is fast enough this increased pressure may substantially exceed the pressure in the fluid in the inlet opening 25 of the housing 21. This causes the fluid which has a higher pressure due to the rotation to move back into the inlet opening 25 causing a churning or axial recirculation of the fluid. This is obviously inefficient.

By utilizing an inlet opening 25 having an outer edge 37 in accordance with the present invention, churning of the fluid can be prevented. In fact, this is one of the desired methods of designing the position of the outer edge 37 of the inlet opening 25. Thus, the outer edge 37 extends inwardly from the outer extent of the opening between the inner and outer gerotors so that fluid will not be forced out of the gap between the inner and outer gerotors due to centrifugal pressure.

A formula for determining the preferred position of the outer edge 37 of the inlet opening 25 in accordance with the present invention can be obtaining by assuming that the fluid in the gap between the inner and outer gerotor rotates at the speed of the inner gerotor. Thus, the rotational velocity of the inner gerotor 15 and the drive shaft 13 can be combined with the design inlet pressure in the inlet opening 25 to result in a design radius for the outer edge 37 of the inlet opening 25. This design radius has its center at the center of rotation of the pumped fluid, which in the illustrated pumps, is at the center of the axis of the drive shaft 13 and inner gerotor 15. A formula for this design which simplifies the calculation to a two dimensional form is based on the standard formula for calculating the pressure in a rotating fluid due to the rotation of the fluid. The formula is as follows:

$$R_2 = \left[ \frac{2P}{\omega^2 \rho} + R_1^2 \right]^{\frac{1}{2}}$$

where P is the design inlet pressure at the pumping chamber, $\omega$ is the design angular velocity of fluid in the inlet cavity (which might be simplified to the angular velocity of the drive shaft 13), $\rho$ is the design density of the fluid to be pumped and $R_1$ is the inner radius of the fluid in the pumping chamber (a radius of the root 35 of the inner gerotor 15). $R_2$ is the radius of the outer edge 37 (the outer radius of the fluid in the pumping chamber).

As can be seen, the inlet opening 25 of the present invention with its reduced outer edge 37 provides a covering to prevent fluid flow back into the inlet opening 25 from the opening gap between the inner and outer gerotors. This covering thus improves the filling efficiency of the inlet by preventing recirculation in the fluid. At the same time the inlet opening remains maximally open with respect to fluid which would be flowing into the inlet opening as provided by the prior art since in the opening of the prior art, fluid was not entering the opening gap at the outer extents anyway.

It can be seen that the prior art maximum size inlet opening 25 shown in FIG. 1 is, in fact, not effectively any larger than the inlet opening of the present invention with respect to fluid which actually can enter the inlet opening at design pressure and velocity. The present invention inlet opening 25, therefore, is maximally open to inwardly flowing fluid even though smaller in size. This smaller opening to achieve the greatest flow and flow efficiency is precisely contrary to the teachings of the prior art.

In addition to the advantages of improving filling efficiency because of a lack of recirculation of the fluid entering the opening gap between the inner and outer gerotors, the present invention also reduces cavitation and erosion which occurs at higher rotational speeds. Cavitation and erosion are reduced because the fluid in the outer portions of the gap between the inner and outer gerotor is maintained at a higher pressure. These outer portions do not "see" the low inlet pressure in the inlet opening 25. Increasing the fluid pressure at the higher velocity locations reduces cavitation and erosion and increases the life of the pump.

Because of the increased filling efficiency and the reduction in cavitation and erosion problems, the present invention allows higher speed pumps than would be possible utilizing the designs of the prior art. This allows the pumping elements to be made thinner while still producing the same flow. This allows the pumps to be lighter which is of critical importance in aircraft pumps. The design of the present invention also allows pumps to be designed for lower inlet pressures than was possible utilizing the designs of prior art pumps. This, in turn, allows for the pumps to operate at higher altitudes in aircraft design. Still further, the present invention allows a greater seal length between the trailing edge of the inlet and the leading edge of the outlet. This reduces flow losses due to face flow at the axial end of the inner and outer gerotors.

As shown in FIGS. 2–4 the inlets and outlets extend on both sides of the housing 21. In some pumps the inlets and outlets extend only on one side of the housing.

An example of the improved efficiency of operation of a pump utilizing the present invention is illustrated by the following comparison of flow rate and inlet pressure in two pumps; one having the inlet of the present invention and one having a conventional inlet as shown in FIG. 1. Each pump is operating at 15,000 RPM and the fluid pumped is an aircraft oil at 200° F. The pumps are identical except for the shape of the inlet.

| Inlet Pressure Inches Hg | Conventional Pump Flow Gallons/Min. | Present Invention Pump Flow Gallons/Min. |
|---|---|---|
| 26 | 4.9 | 5.1 |
| 20 | 4.9 | 5.1 |
| 15 | 4.7 | 5.1 |
| 10 | 4.4 | 5.1 |

-continued

| Inlet Pressure Inches Hg | Conventional Pump Flow Gallons/Min. | Present Invention Pump Flow Gallons/Min. |
|---|---|---|
| 9 | 4.2 | 5.0 |
| 8 | 4.0 | 4.9 |
| 7 | 3.7 | 4.5 |

In this example the improved efficiency of the present invention pump is well illustrated. Even at higher inlet pressures, the flow is improved. Lowering the inlet pressure does not affect the flow as quickly as the conventional pump; i.e., the pump of the present invention can maintain its optimum flow at a lower inlet pressure than a conventional pump. And when the flow of the pump of the present invention does begin to be affected by the lower inlet pressure, the rate at which it is affected is lower.

Figure 5:
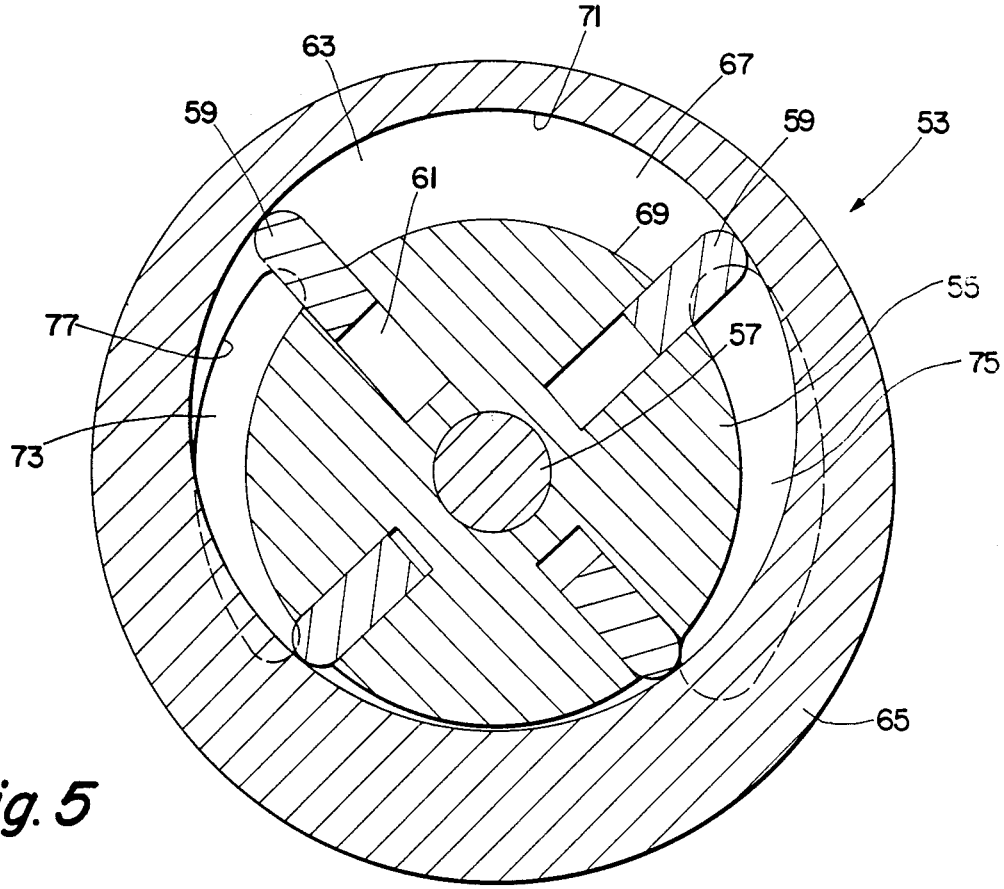
FIG. 5 is a cross-sectional view of an alternate positive displacement pump constructed in accordance with the present invention.

As is apparent from the above description, the present invention operates effectively in the design of a gerotor pump. However, the concept of the present invention can also be utilized on other positive displacement rotary pumps. An example of a vane pump utilizing the design of the present invention is shown in FIG. 5. In the vane pump 53 a rotor 55 is driven by a drive shaft 57. Vanes 59 are held in slots 61 in the rotor 55 and can move radially inwardly and outwardly therein. The rotor 55 and vanes 59 rotate within and are sealed within a cylindrical opening 63 in a housing 65. The cylindrical opening 63 has an axis which is radially offset from the axis of the drive shaft 57 and the rotor 55 creating a radial gap 67 between the radially outer edge 69 of the rotor 55 and the radially inner edge 71 of the housing 65 which creates the cylindrical opening 63 (edge 71 is the outer extent of the cylindrical opening 63). The vanes 59 travel outwardly to the housing edge 71 as the rotor 55 rotates. An inlet opening 73 and an outlet opening 75 are provided in the housing 65 axially adjacent the rotor 55 and the vanes 59. As the rotor 55 moves clockwise fluid is drawn into the radial gap 67 on the left side of the pump in FIG. 5 and expelled into the outlet 75 on the right side of the pump.

In accordance with the present invention the radially outer edge 77 of the inlet opening 73 extends inwardly from the edge 71 in order to prevent fluid which has entered the gap from moving back into the inlet opening 73 due to fluid pressure created in the gap 67 because of rotation of the fluid. The radius of this edge 77 can be calculated using the same formula as used for the gerotor pump. This vane pump opening prevents axial churning of the fluid in the same manner as the inlet shown with respect to the gerotor pump of the present invention.

Thus, the pump of the present invention is well adapted to achieve the objects and advantages mentioned as well as those inherent therein. It will be appreciated that the instant specification and claims are set forth by way of illustration and not of limitation, and that various changes and modifications may be made without departing from the spirit and scope of the present invention.

What is claimed is:

1. An improved positive displacement pump having a high speed, single direction rotary displacement mechanism and a housing surrounding the rotary displacement mechanism and cooperating therewith to form a displacement inlet cavity which, during rotation of said rotary displacement mechanism, extends radially inwardly to a radially inner boundary, radially outwardly to a radially outer boundary, and receives fluid through an axial housing inlet disposed in said housing axially adjacent the displacement mechanism between said radially inner boundary and said radially outer boundary; the improvement comprising:

said axial housing inlet having a radially outer covering edge, a radially inner edge, a leading edge and a trailing edge; with said radially inner edge extending substantially along said radially inner boundary and said radially outer covering edge extending radially inwardly of said radially outward boundary and covering an outer section of said displacement inlet cavity such that fluid which has entered said displacement inlet cavity through said housing inlet will not exit said displacement inlet cavity through said housing inlet due to fluid pressure created in said displacement inlet cavity by rotation of the fluid; and wherein said rotary displacement mechanism cooperates with said housing to form a displacement outlet cavity which, during rotation of said displacement mechanism extends to a radially inner outlet boundary and a radially outer outlet boundaries; and wherein said housing further comprises an axial housing outlet having a leading edge, a trailing edge and a radially outer edge which extends at least radially outwardly to said radially outer outlet boundary from said leading edge to said trailing edge.

* * * * *